US010355386B2

(12) United States Patent
Soudy

(10) Patent No.: US 10,355,386 B2
(45) Date of Patent: Jul. 16, 2019

(54) ELECTRICAL CONNECTOR WITH CONTACT CONFIGURED FOR SURFACE MOUNT

(71) Applicant: FCI USA LLC, Etters, PA (US)

(72) Inventor: Aymeric Soudy, Besancon (FR)

(73) Assignee: FCI USA LLC, Etters, PA (US)

( * ) Notice: Subject to any disclaimer, the term of this patent is extended or adjusted under 35 U.S.C. 154(b) by 0 days.

(21) Appl. No.: 15/548,534

(22) PCT Filed: Feb. 3, 2016

(86) PCT No.: PCT/US2016/016258
§ 371 (c)(1),
(2) Date: Aug. 3, 2017

(87) PCT Pub. No.: WO2016/126751
PCT Pub. Date: Aug. 11, 2016

(65) Prior Publication Data

US 2018/0013224 A1 Jan. 11, 2018

Related U.S. Application Data

(60) Provisional application No. 62/111,245, filed on Feb. 3, 2015.

(51) Int. Cl.
*H01R 13/11* (2006.01)
*H01R 13/41* (2006.01)
(Continued)

(52) U.S. Cl.
CPC ..... *H01R 13/41* (2013.01); *H01R 12/57* (2013.01); *H01R 13/112* (2013.01); *H01R 43/16* (2013.01);
(Continued)

(58) Field of Classification Search
CPC .. H01R 13/2457; H01R 12/112; H01R 13/112
See application file for complete search history.

(56) References Cited

U.S. PATENT DOCUMENTS 4,907,990 A * 3/1990 Bertho ..... H01R 13/11 439/682
5,188,535 A 2/1993 Bertho et al.
(Continued)

FOREIGN PATENT DOCUMENTS

JP 2013-080623 A 5/2013
JP 2014-041727 A 3/2014
WO WO2011/143807 A1 * 11/2011 ..... H01R 13/112

OTHER PUBLICATIONS

International Search Report and Written Opinion for International Application No. PCT/US2016/016258 dated May 24, 2016.
(Continued)

*Primary Examiner* — Tho D Ta
(74) *Attorney, Agent, or Firm* — Wolf, Greenfield & Sacks, P.C.

(57) ABSTRACT

An electrical connector including a housing; and a plurality of electrical contacts connected to the housing. Each of the contacts includes opposing cantilevered contact arms configured to receive a male contact of a mating electrical connector therebetween. Each of the contacts has a retention feature assisting in locating the contact in a contact receiving area of the housing and a first surface mount solder tail.

23 Claims, 24 Drawing Sheets

(51) Int. Cl.
*H01R 12/57* (2011.01)
*H01R 43/16* (2006.01)
*H01R 13/24* (2006.01)

(52) U.S. Cl.
CPC ..... *H01R 13/113* (2013.01); *H01R 13/2457* (2013.01)

(56) References Cited

U.S. PATENT DOCUMENTS 5,224,885 A 7/1993 Youngfleish
5,263,883 A * 11/1993 Kirayoglu ..... H01R 43/16 439/856
5,788,539 A * 8/1998 Fedder ..... H01R 4/2429 439/682
6,551,143 B2 * 4/2003 Tanaka ..... H01R 12/7088 439/224
7,527,529 B2 * 5/2009 Ho ..... H01R 12/57 439/660
7,621,784 B2 * 11/2009 Ichimiya ..... H01R 12/57 439/676
7,938,649 B2 * 5/2011 Gattuso ..... H01R 12/57 439/71
7,950,966 B1 * 5/2011 Chen ..... H01R 24/58 439/668
8,882,533 B2 * 11/2014 Brandberg ..... H01R 13/193 439/441
2004/0147177 A1 7/2004 Wagner
2009/0124128 A1 5/2009 Regnier
2011/0201222 A1 8/2011 Potters
2013/0157518 A1 * 6/2013 Wang ..... H01R 12/57 439/682
2014/0187098 A1 * 7/2014 Kobayashi ..... H01R 12/91 439/660
2016/0064848 A1 * 3/2016 Yu ..... H01R 13/41 439/682

OTHER PUBLICATIONS

Extended European Search Report for European Application No. 16747147.3 dated Sep. 5, 2018.

* cited by examiner

ELECTRICAL CONNECTOR WITH CONTACT CONFIGURED FOR SURFACE MOUNT

RELATED APPLICATIONS

This application is the U.S. National Stage of and claims priority to and the benefit of International Patent Application Number PCT/US2016/016258, entitled "ELECTRICAL CONTACT" filed on Feb. 3, 2016, which claims priority under 35 U.S.C. § 119(e) to U.S. Provisional Application Ser. No. 62/111,245, entitled "ELECTRICAL CONTACT" filed on Feb. 3, 2015, which is herein incorporated by reference in its entirety. The entire contents of these applications are incorporated herein by reference in their entirety.

BACKGROUND

Technical Field

The exemplary and non-limiting embodiments relate generally to an electrical contact and, more particularly, to a female electrical terminal.

Brief Description of Prior Developments

Electrical contacts are known which have opposing contact arm and which are mounted to a housing in a contact receiving area.

SUMMARY

The following summary is merely intended to be exemplary. The summary is not intended to limit the scope of the claims.

In accordance with one aspect, an example embodiment is provided in an electrical connector comprises a housing; and a plurality of electrical contacts connected to the housing, where each of the contacts comprise opposing cantilevered contact arms configured to receive a male contact of a mating electrical connector therebetween, a retention feature assisting in locating the contact in a contact receiving area of the housing, and a first surface mount solder tail.

In accordance with another aspect, an example method comprises stamping a flat metal member to form an electrical contact attached to a carry strip, where the electrical contact is stamped to form opposing cantilevered contact arms configured to receive a male contact of a mating electrical connector therebetween, a retention feature assisting in locating the contact in a contact receiving area of the housing, and a first surface mount solder tail; and rolling the carry strip with the electrically contact attached onto a roll.

BRIEF DESCRIPTION OF THE DRAWINGS

The foregoing aspects and other features are explained in the following description, taken in connection with the accompanying drawings, wherein.

DETAILED DESCRIPTION OF EMBODIMENTS

Figure 1:
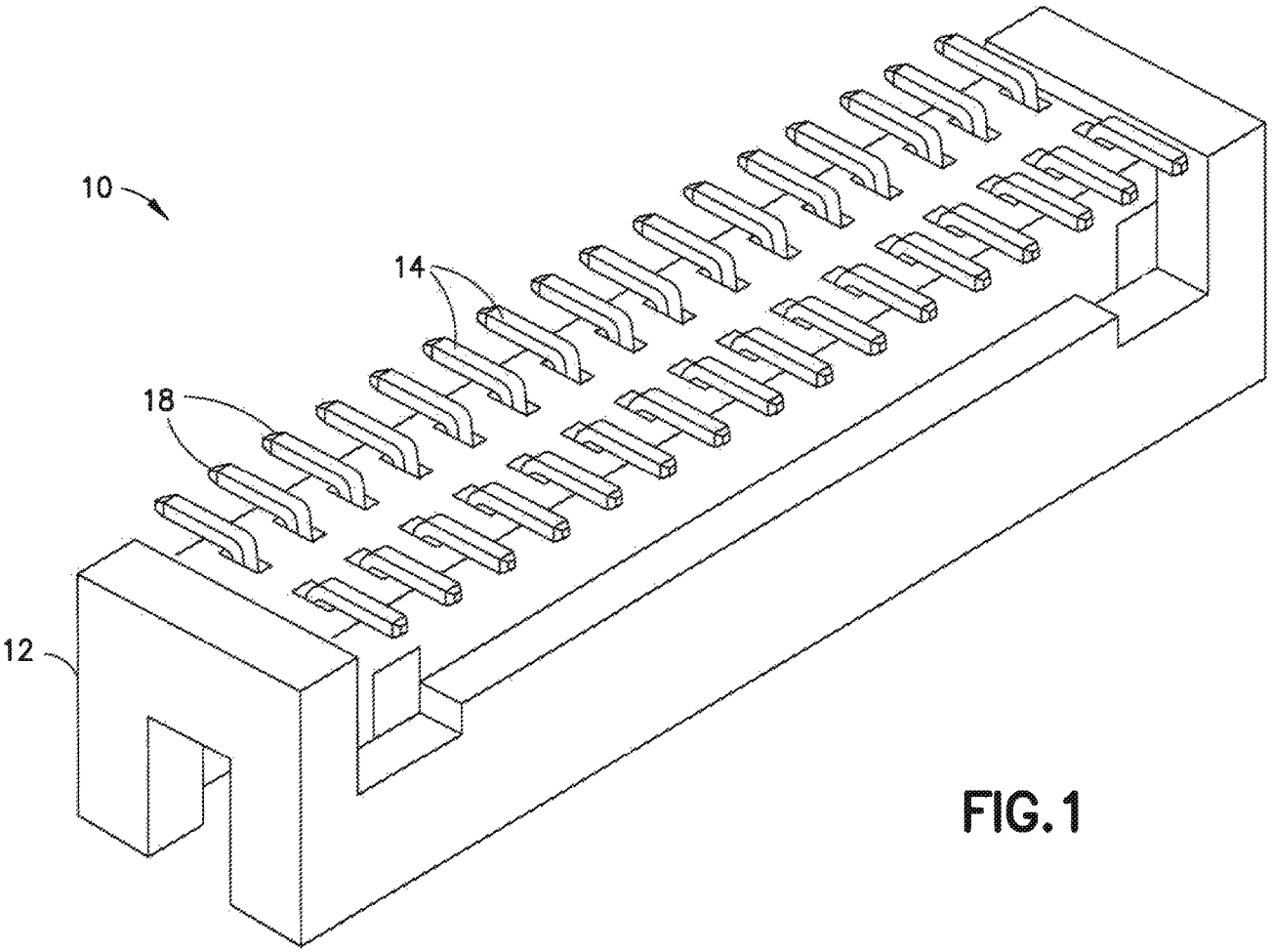
FIG. 1 is a bottom perspective view of an example embodiment of an electrical connector.

Referring to FIG. 1, there is shown a bottom perspective view of an electrical connector 10 incorporating features of an example embodiment. Although the features will be described with reference to the example embodiments shown in the drawings, it should be understood that features can be embodied in many alternate forms of embodiments. In addition, any suitable size, shape or type of elements or materials could be used.

Figure 2:
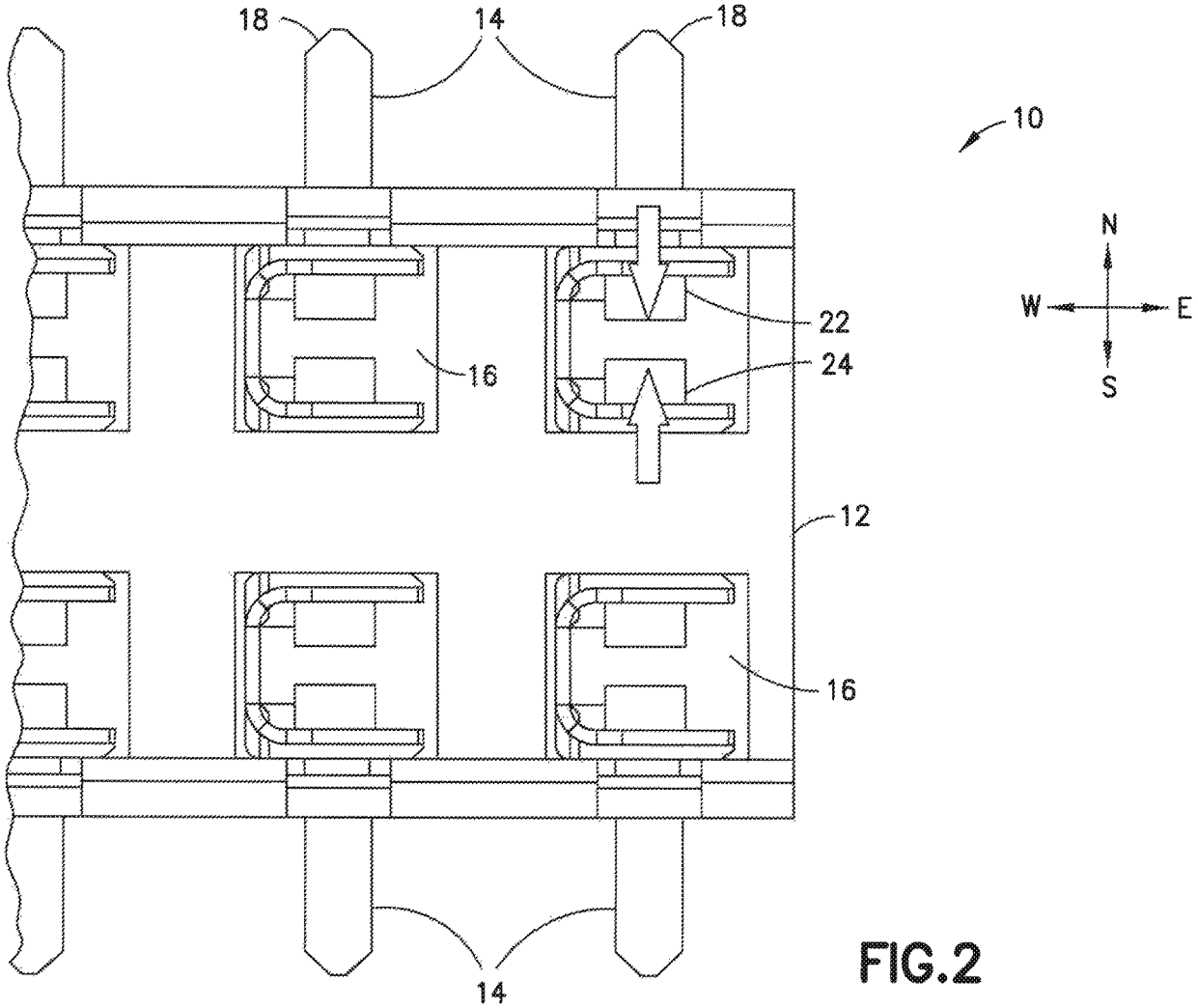
FIG. 2 is a partial schematic top view of the example shown in FIG. 1.
Figure 3:
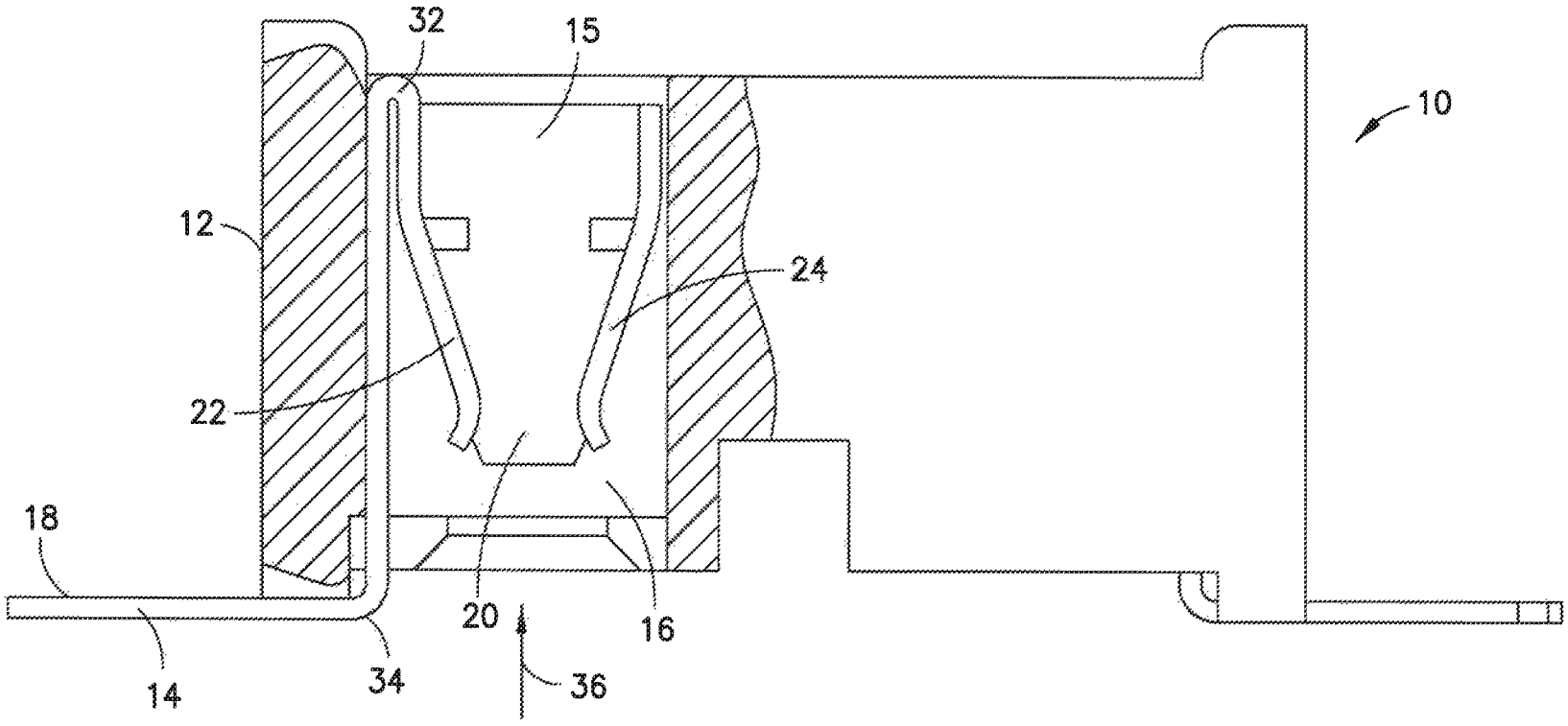
FIG. 3 is a side view of the example shown in FIGS. 1-2 with a cut away section.

The connector 10 generally comprises a housing 12 and a plurality of electrical contacts or terminals 14. Referring also to FIGS. 2-3, the housing 12 is preferably comprised of molded plastic or polymer material. The housing 12 has a plurality of contact receiving areas 16. In this example the contact receiving areas 16 are arranged in two parallel rows along the length of the housing. The top side of the housing is configured to have a mating connector (not shown) located thereat with male pins or contacts of the mating connector extending into the contact receiving areas 16 through the tops side to make electrical contact with the contacts 14.

Figure 4:
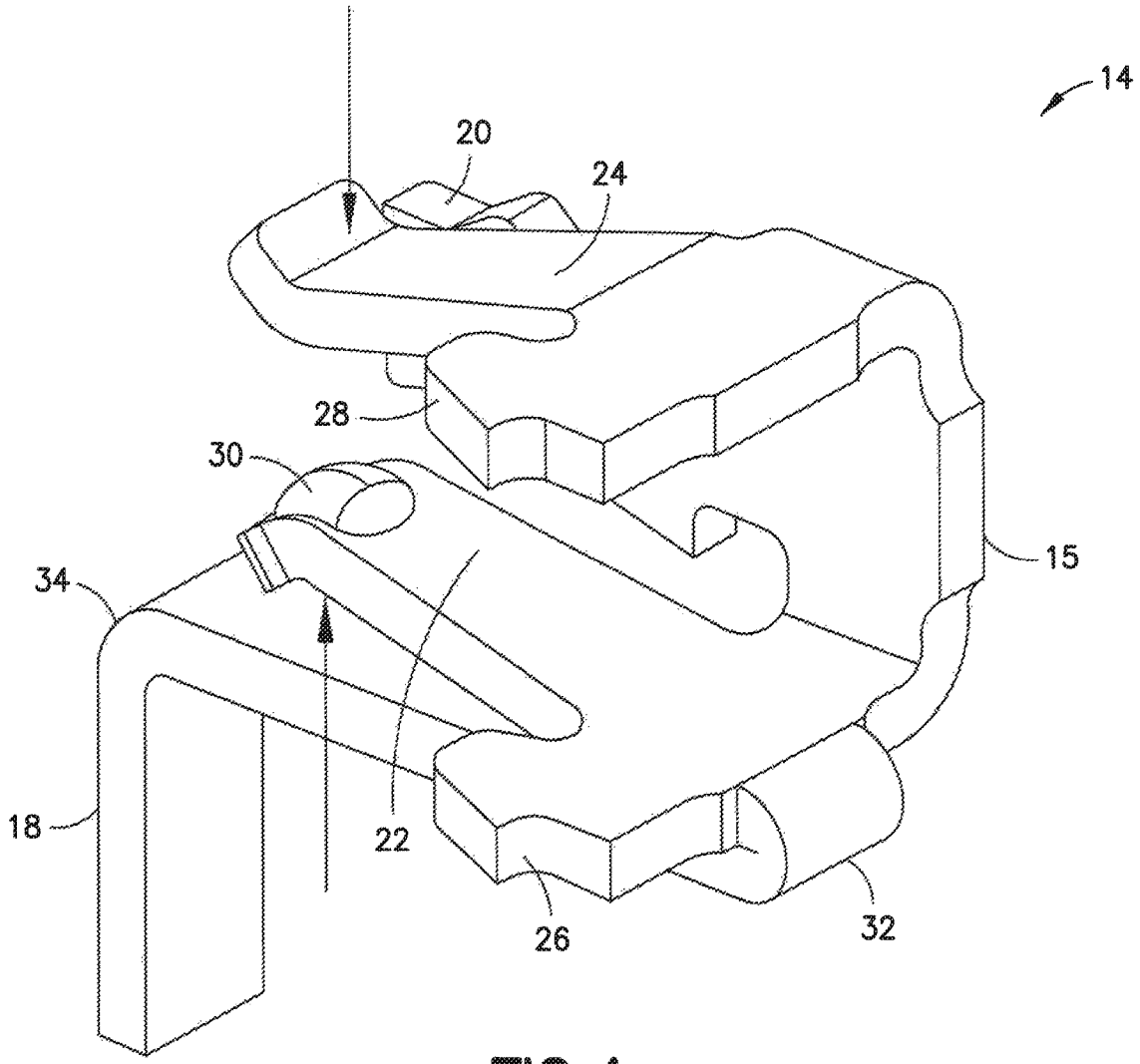
FIG. 4 is a perspective view of one of the electrical contacts shown in FIGS. 1-3.
Figure 5:
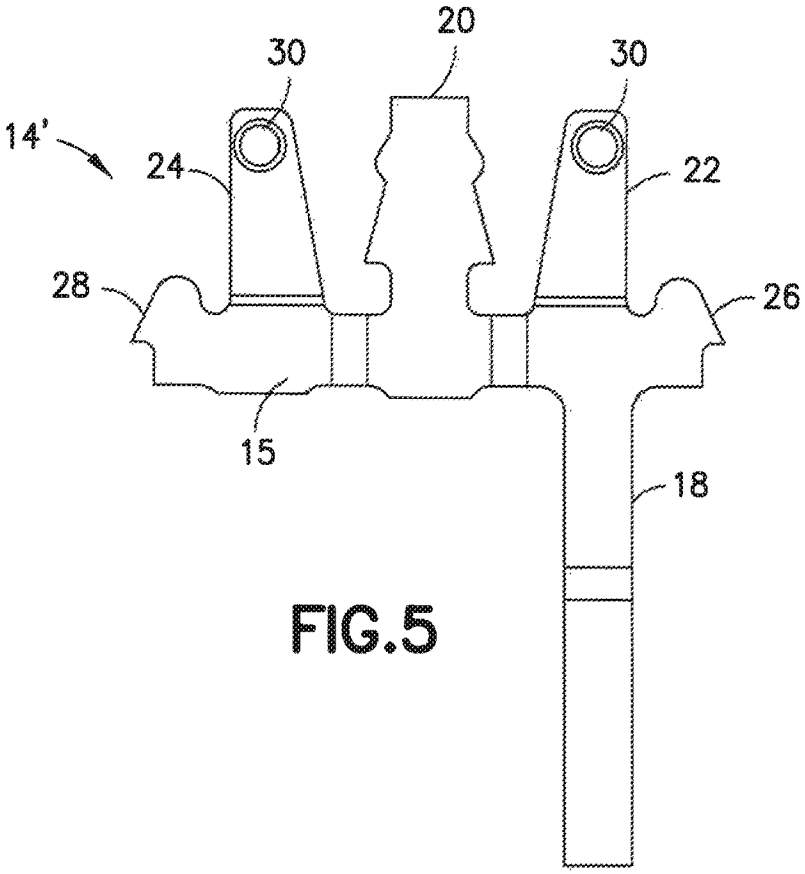
FIG. 5 is a plan view of a blank used to form the electrical contact shown in FIG. 4.

Referring also to FIGS. 4-5, the contacts 14 in this example are female contacts having right angle solder tails. With the right angle solder tails, the connector 10 is configured to be surface mounted on another member (not shown), such as by soldering for example. FIG. 5 shows a stamped blank 14' of sheet metal before being bent into the shape shown in FIG. 4. The contact 14 comprises a main section 15, the solder tail 18, a mounting section or retention feature 20, and two opposing contact arms 22, 24. In an alternate example embodiment more or less that two contacts arms could be provided, and the arms might not be opposing. The solder tail 18, the mounting section 20, and the two contact arms 22, 24 extend off of the main section 15 in a general cantilever fashion. The solder tail 18 is generally aligned with the first contact arm 22 and offset from the mounting section 20. Opposite ends of the main section 15 also comprise mounting portions 26, 28. The mounting section 20 and mounting portions 26, 28 allow the contact 14 to be inserted into one of the contact receiving areas 16 of the housing 12, and fixedly attach the contact to the housing 12.

The two contact arms 22, 24 are bent inward to from a mating contact receiving area therebetween. The arms 22, 24 have contact areas 30 for contacting the mating contact therebetween. The solder tail 18 is bent about 180 degrees from the main section 15 at bend 32, and then bent about 90 degrees at bend 34 to from the right angle of the solder tail. Thus, in its final shape shown in FIG. 4, the solder tail 18, the mounting section 20, and the two contact arms 22, 24 all extend in a general same direction away from the main section 15. The solder tail 18 is on the same side as the first contact arm 22.

As seen in FIGS. 2 and 3, the solder tails 18 extend away from the housing 12 at the lateral sides of the housing. Because of the shape of the contact, the first contact arm 22 is located closer to its respective lateral side of the housing 12 than the second contact arm 24. As shown by the arrows in FIGS. 2 and 4, this results in the force to be exerted on the inserted male contact (between the opposing contact areas 30) to be in-line with the solder tail's lateral extension from the housing; not perpendicular.

Features with the example shown in FIGS. 1-5 include a terminal bottom entry (entry of the terminal into the housing via the bottom end of the housing) and a North/South contact orientation rather than an East/West orientation of the contact arms. The terminal bottom entry allows the contact 14 to be inserted into the housing 12 through the bottom of the housing as indicated by arrow 36 in FIG. 3. Bottom entry allows an "East-West" contact point to be provided for the surface mount (SMT) solder tail 18. By providing the North/South contact orientation of the contact arms in-line with the solder tail 18, this orientation of the contact may allow an important cost reduction regarding the platting of the contact.

Figure 6:
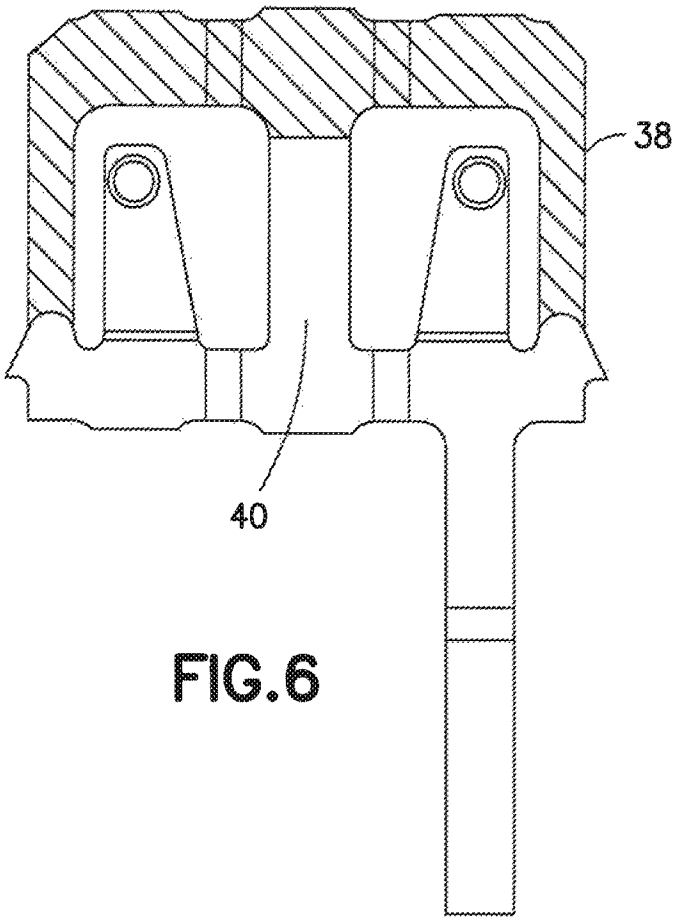
FIG. 6 is a plan view similar to FIG. 5 showing a bridging portion.

Referring also to FIG. 6, an alternative design for the contact is shown. In this example the contact comprises an additional bridge portion 38. This bridge portion 38 could be optionally removed to provide a contact similar to FIG. 5. Bridge area 38 could be deleted in the tool to create the low profile design. Area 40 could be modified in the tool to create the low profile features of retention shown in FIG. 5 or the high profile version shown in FIG. 6. Several versions of connector products may be from several different types of contacts for a concerning product family. This universal bridge terminal, by having portion(s) removed or not removed, will bring the possibility to obtain (only with one tool and versions):

High or Low profile version

Offer the possibility to create several kind of solder tails all around the bridge This solution will help to save money (minimize number of tool) and enhance the competitiveness.

Figure 7:
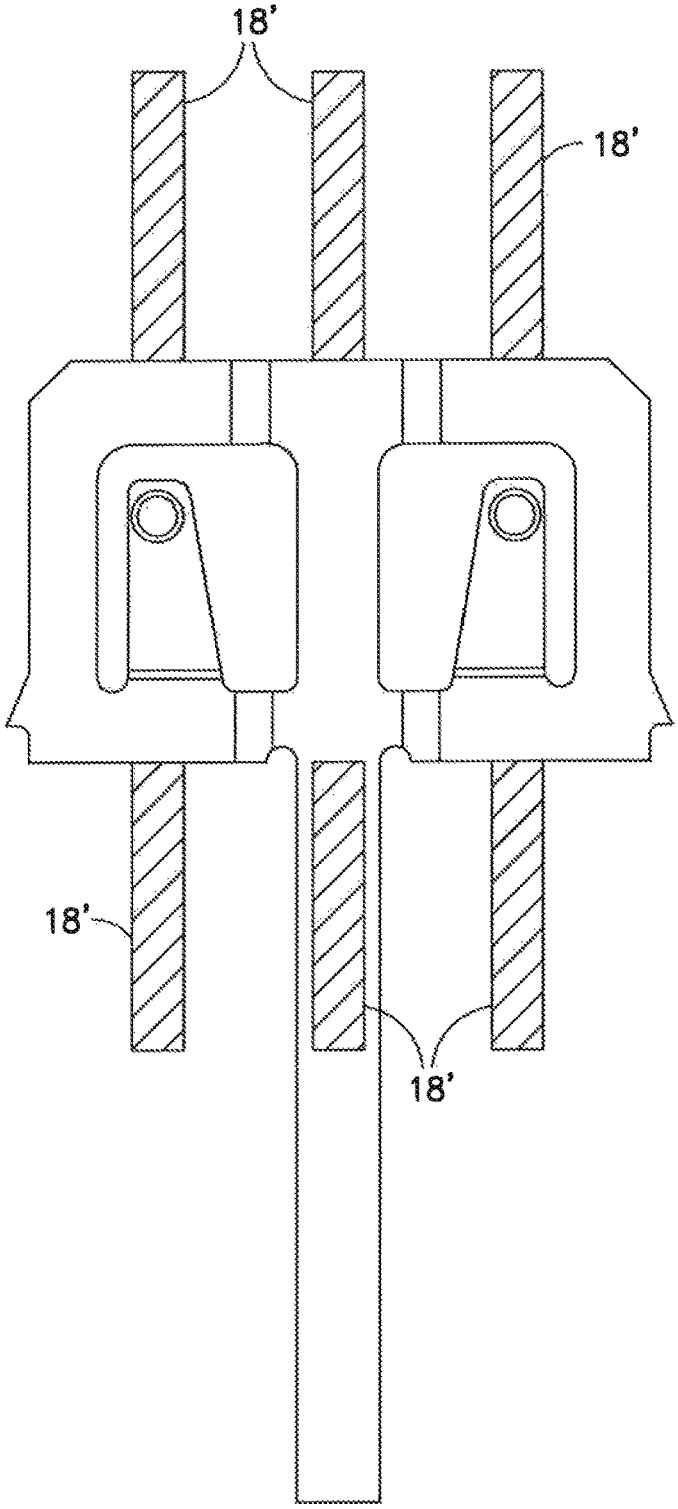
FIG. 7 is a plan view similar to FIG. 6 showing possible locations for solder tails.
Figure 8:
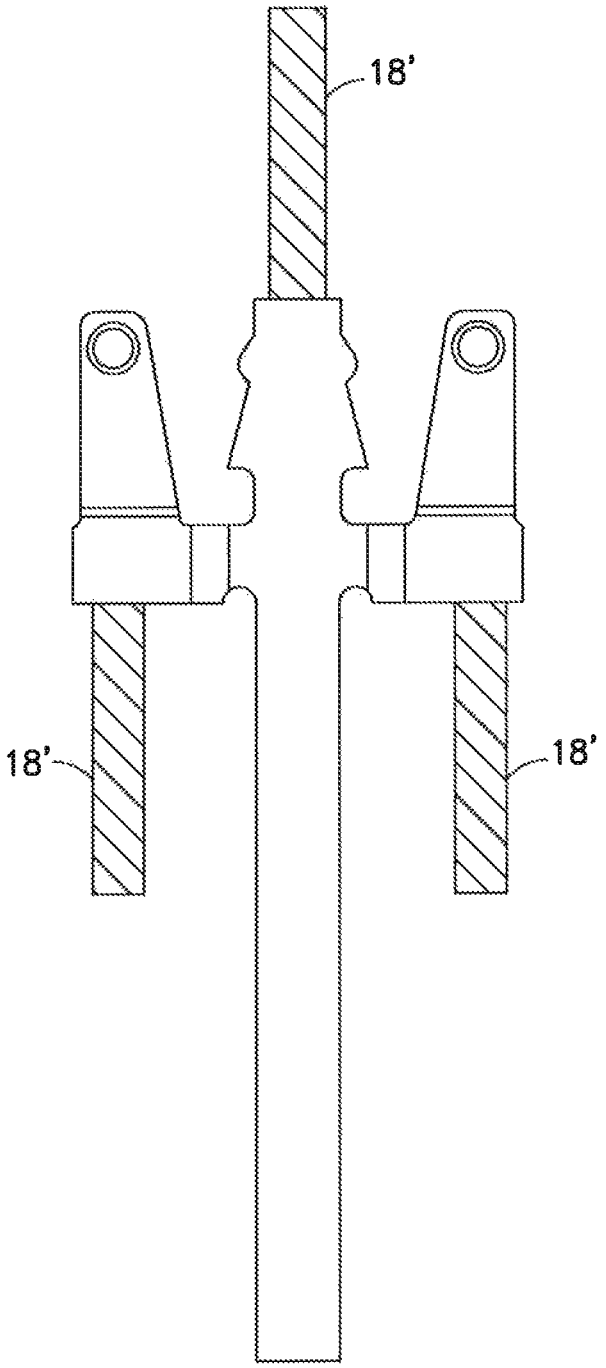
FIG. 8 is a plan view similar to FIG. 7 showing an electrical contact without a bridging portion and showing possible locations for solder tails.

FIGS. 7 and 8 show alternative designs showing additional or alternative possible locations of one or more solder tails 18'.

Figure 10:
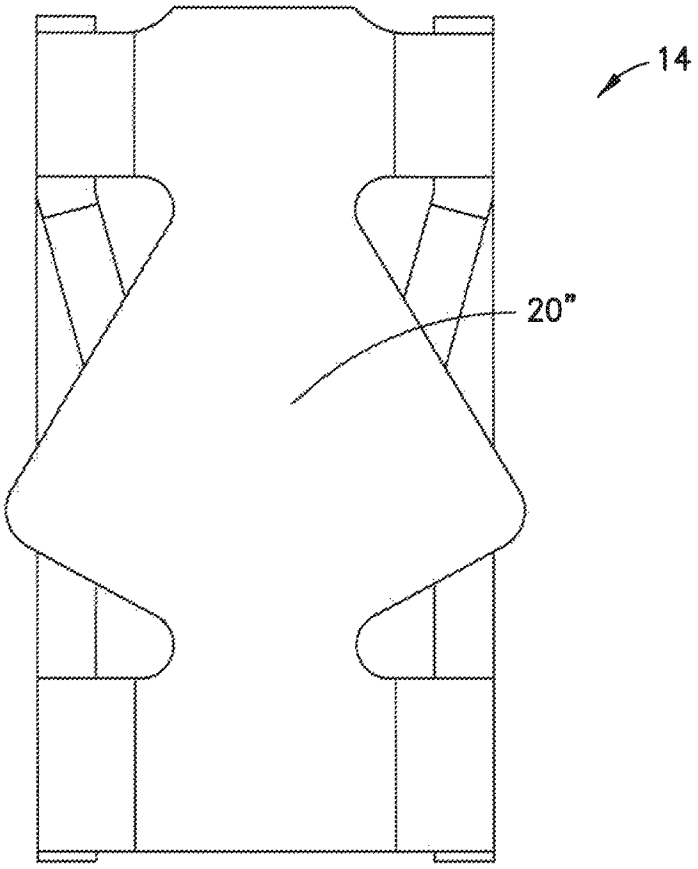
FIG. 10 shows a rear side view similar to FIG. 9 of an alternate shape of retention feature.
Figure 9:
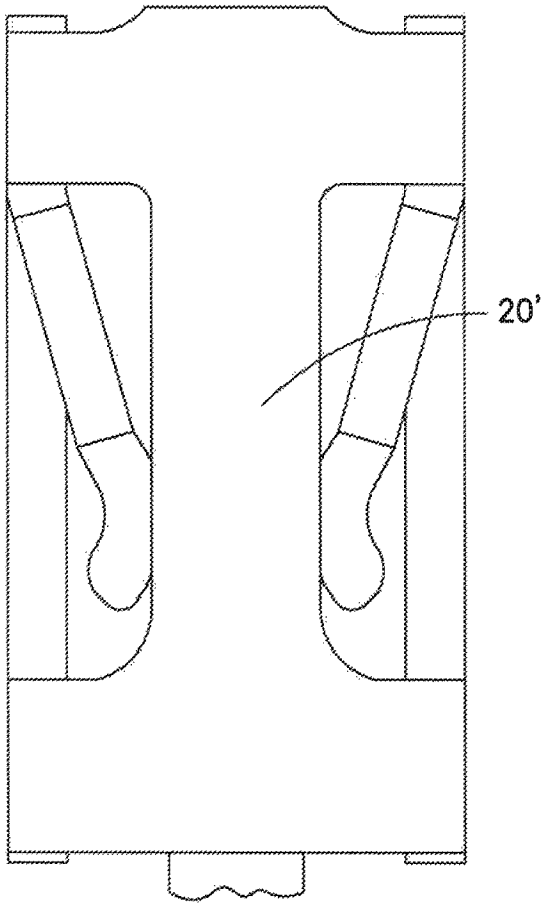
FIG.9 PRIOR ART
FIG. 9 shows a rear side view of a conventional electrical contact.
Figure 12:
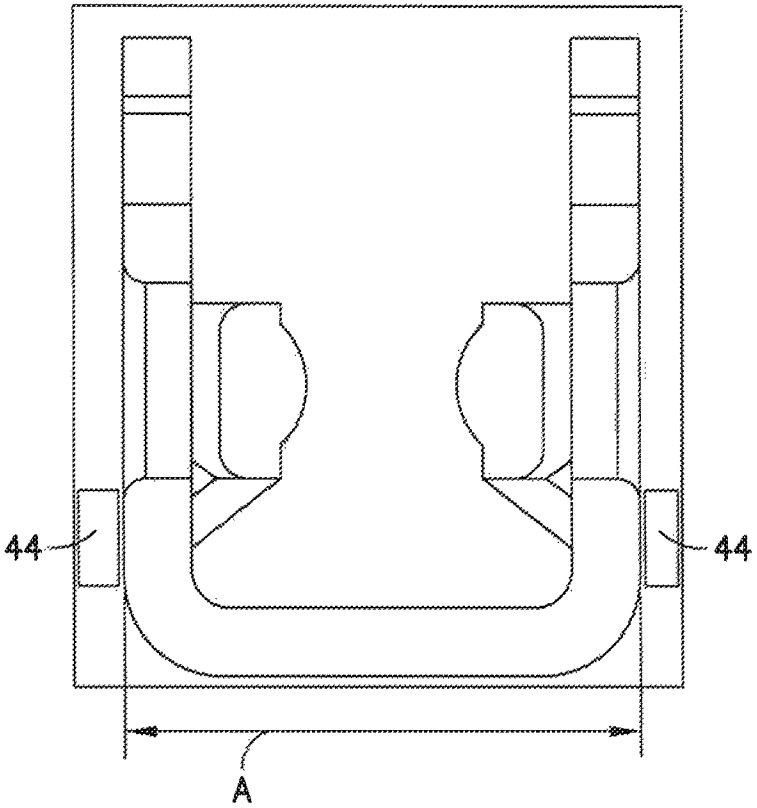
FIG. 12 shows a width of the conventional contact shown in FIG. 9.

FIG. 9 shows a portion of a conventional contact which has a section 20'. FIG. 10 shows the contact 14, but with a different mounting portion 20". The width of the mounting portion 20" has a dimension B shown in FIG. 13 which is larger than the dimension A shown in FIG. 12 for the contact shown in FIG. 9.

Figure 13:
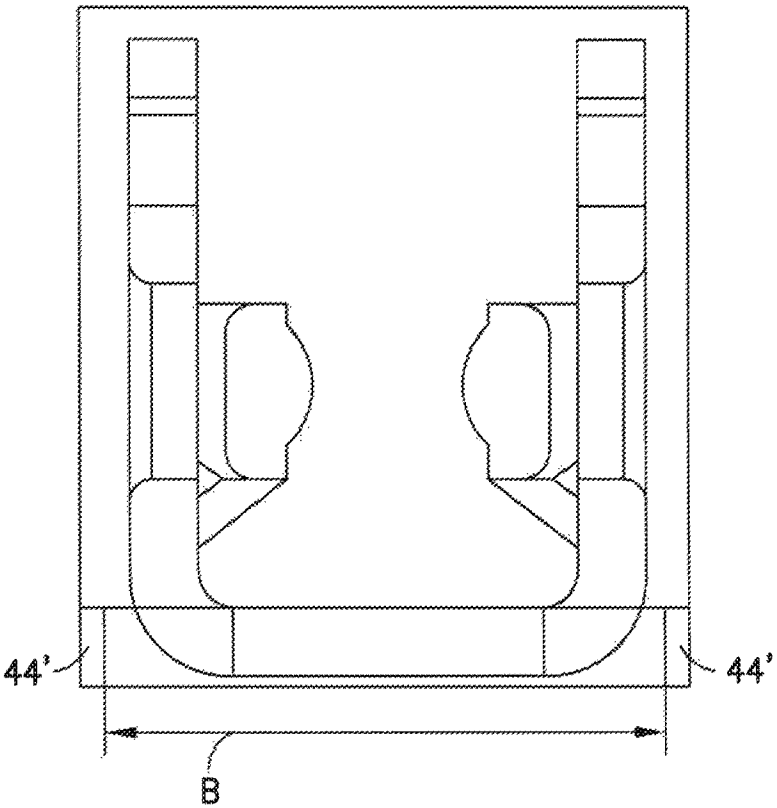
FIG. 13 shows a width of the contact shown in FIG. 10.

The extra feature will bring a dimension "B" obtained from stamping process instead of dimension "A" from bending and will provide a better position of the terminal into the cavity due to a difference of the tolerances capability of stamping versus bending. As shown by areas 44 in FIG. 12, a clearance due to big tolerances from bending of the contact shown in FIG. 9 exists between the contact and the housing. This could have a bad alignment between the axis of the terminal and the window in the housing 12 for the mail pin of the mating connector. This issue is mainly due to a large tolerances of the terminal from the bending process resulting in dimension A; which impact the assembly references. The mounting portion 20", however, is not bent. It is stamped. With features as described herein, references from cutting step instead of the bending step of the process may be used for manufacturing and assembly. Effectively, the cutting process may provide a total tolerance of 0.02 mm (instead of 0.1 mm for the bending features). Thus, as shown in FIG. 13, the area 44' of clearance is much smaller than the area 44. A small clearance is due to small tolerances from cutting. As seen with FIG. 14, the extra feature at 20" will bring a dimension "B" obtained from stamping process instead of dimension "A" from bending and will provide a very better position of the terminal into the cavity due to a difference of the tolerances capability.

FIGS. 15-29 show some alternative designs for the contacts.

An example embodiment may be provided in an electrical connector comprising a housing; and a plurality of electrical contacts connected to the housing, where each of the contacts comprise opposing cantilevered contact arms configured to receive a male contact of a mating electrical connector therebetween, a retention feature assisting in locating the contact in a contact receiving area of the housing, and a surface mount solder tail.

Figure 14:
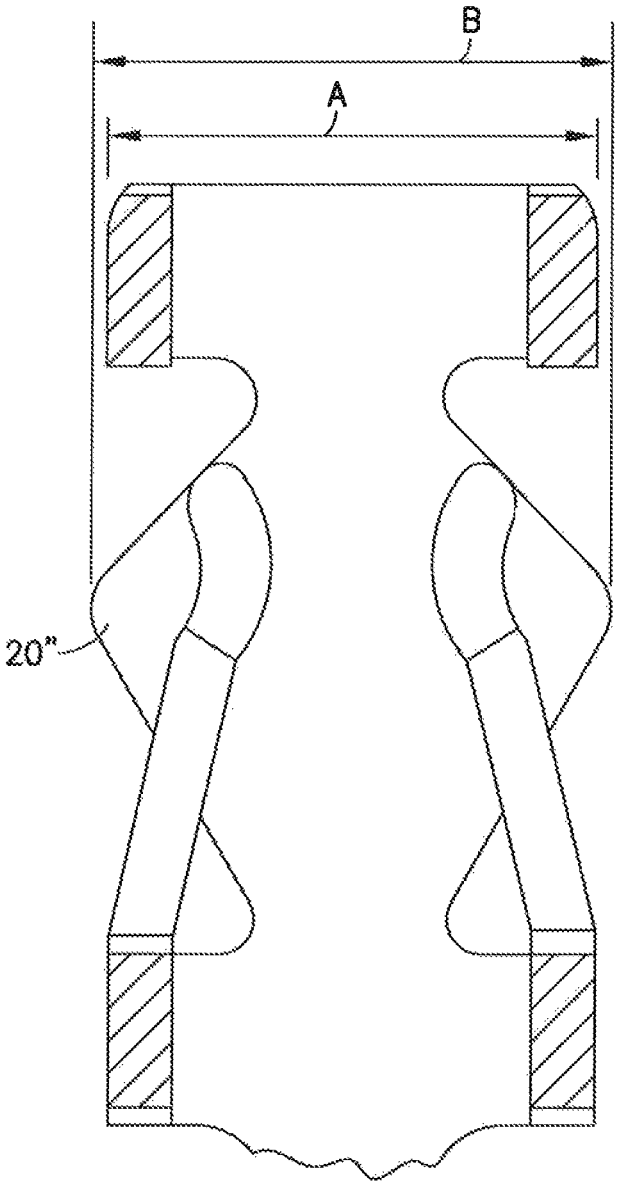
FIG. 14 is a cross sectional view of the contact shown in FIGS. 10 and 13.
Figure 15:
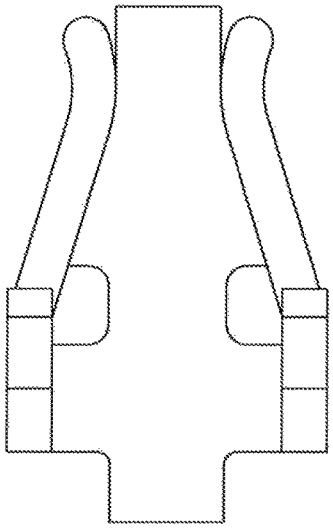
FIGS. 15-16 show an alternate shapes.
Figure 16:
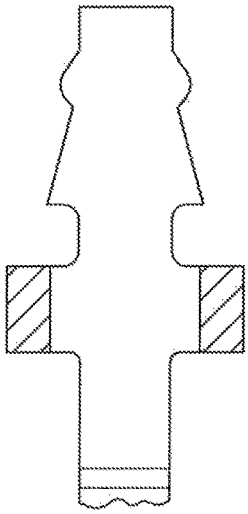

The contact arm, retention feature and solder tail may extend in a same direction from a main body of the contact as seen in FIG. 4 for example. The retention feature may have a general cantilevered shape extending from the main body of the contact as seen in FIGS. 4-5 for example. The contact may further comprise a bridging portion connected to the retention feature and opposite ends of the main body of the contact as seen in FIG. 6 for example. The retention feature may be the widest portion of the contact and extend past opposite sides of the contact proximate the contact arms as seen in FIGS. 5, 10 and 14 for example, where the retention feature is flat and not bent.

Figure 11:
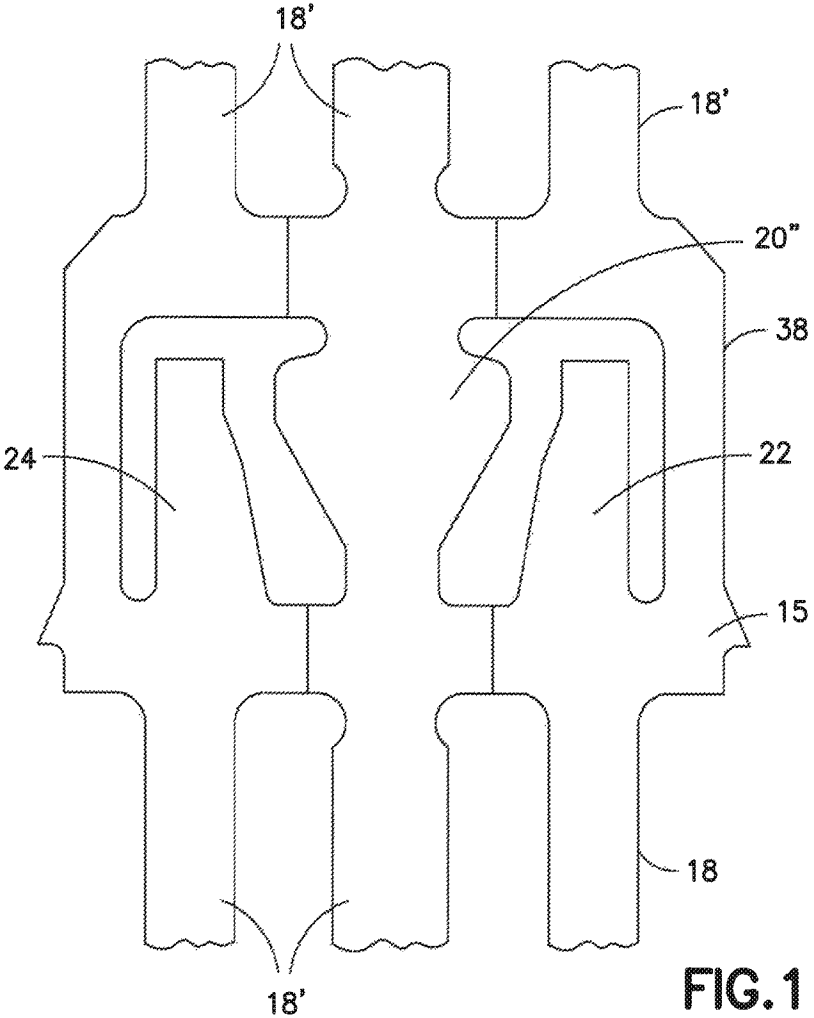
FIG. 11 is a plan view of a flat blank used to form the electrical contact shown in FIG. 10 and showing removable solder tails for solder tail location configurability.
Figure 17:
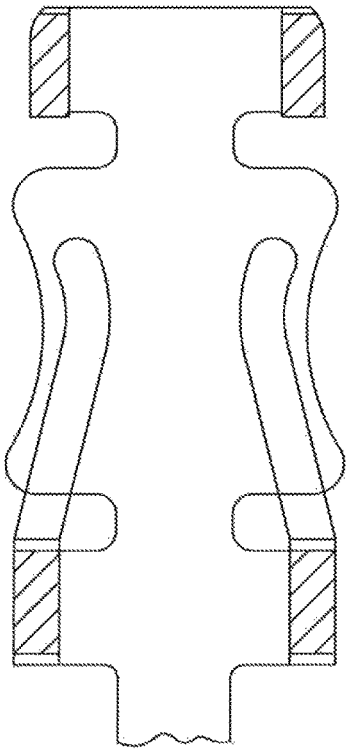
FIG. 17 shows a retention feature with an hour-glass shaped profile.
Figure 18B:
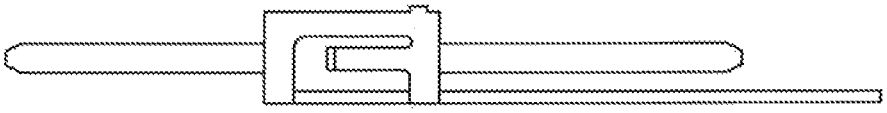
FIGS. 18A-29B shows various alternate design shapes of electrical contacts have features as described herein.
Figure 18A:
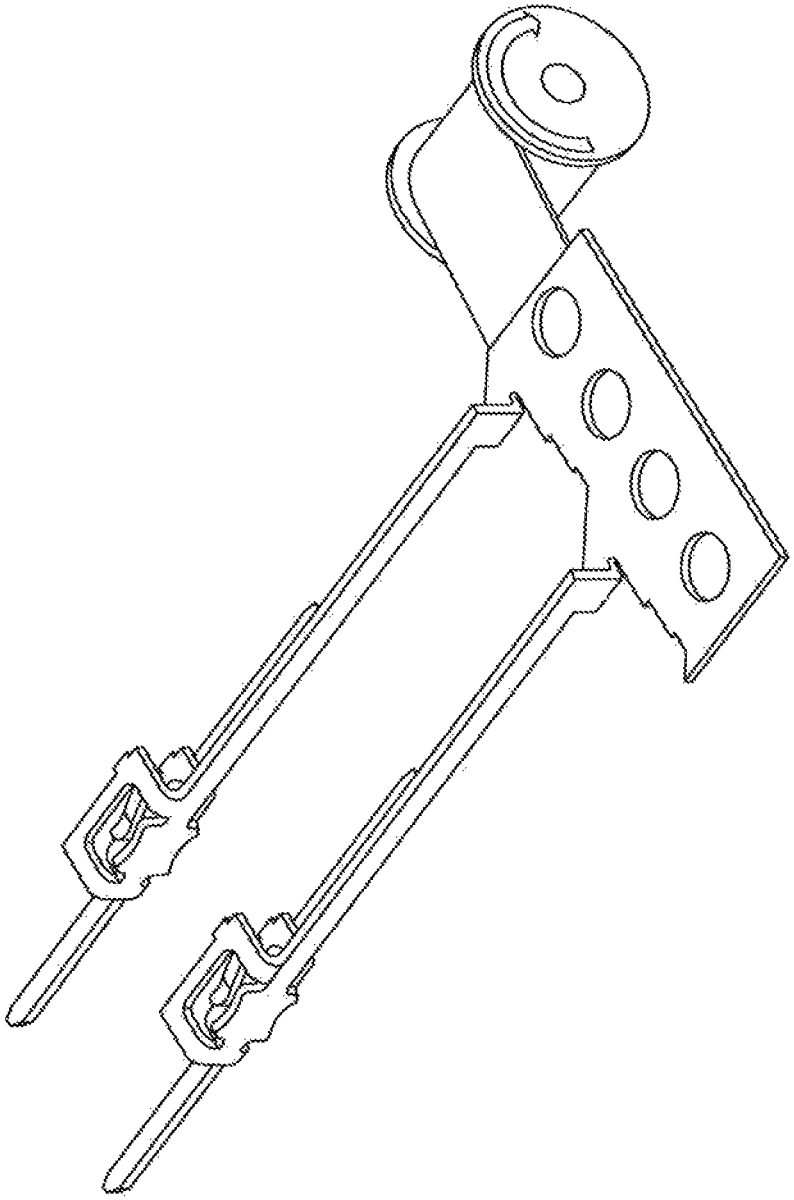
Figure 19B:
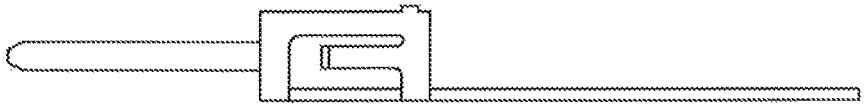
Figure 19A:
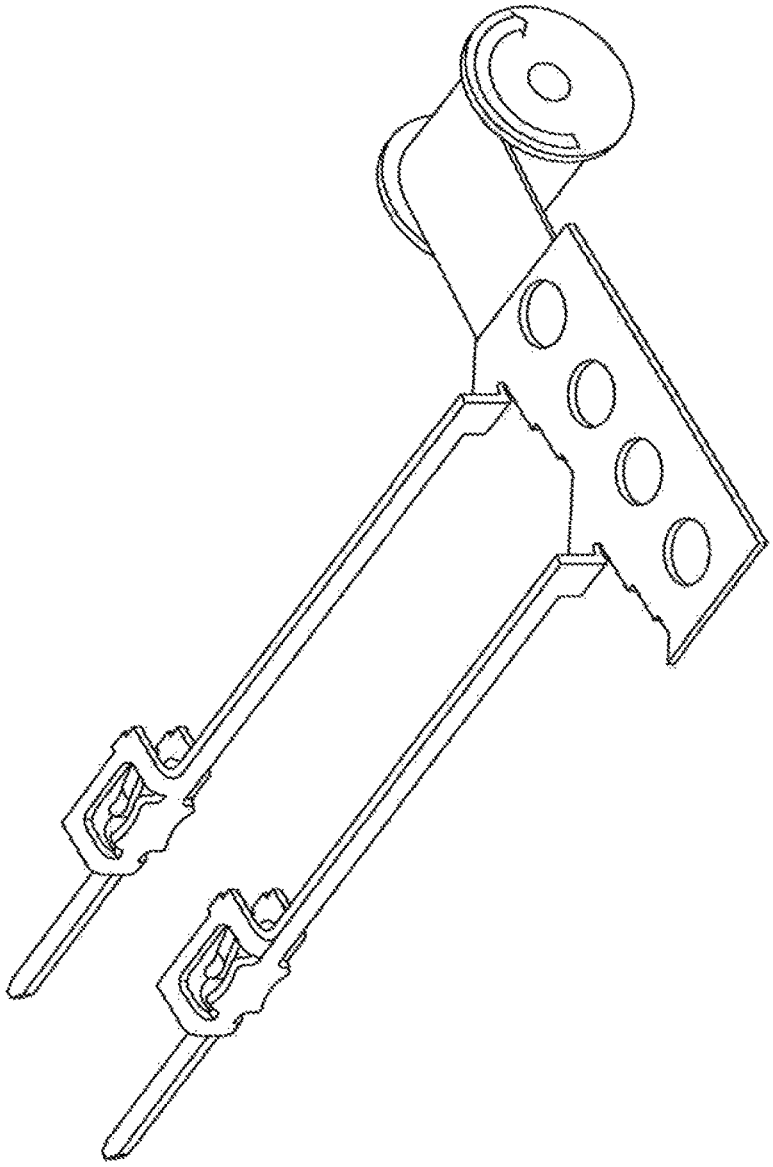
Figure 20B:
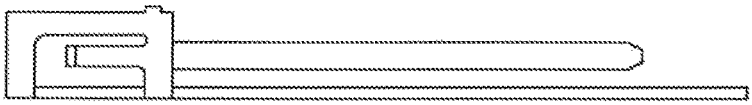
Figure 20A:
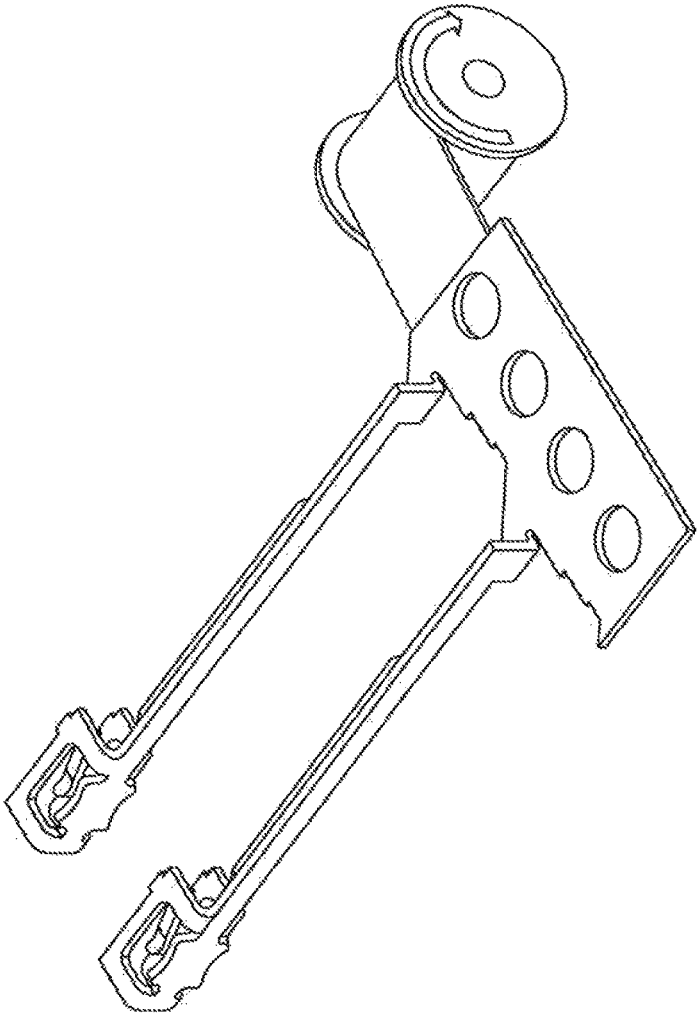
Figure 21B:
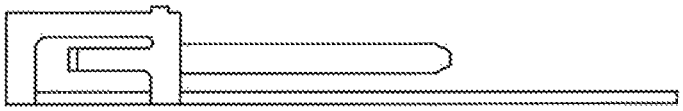
Figure 21A:
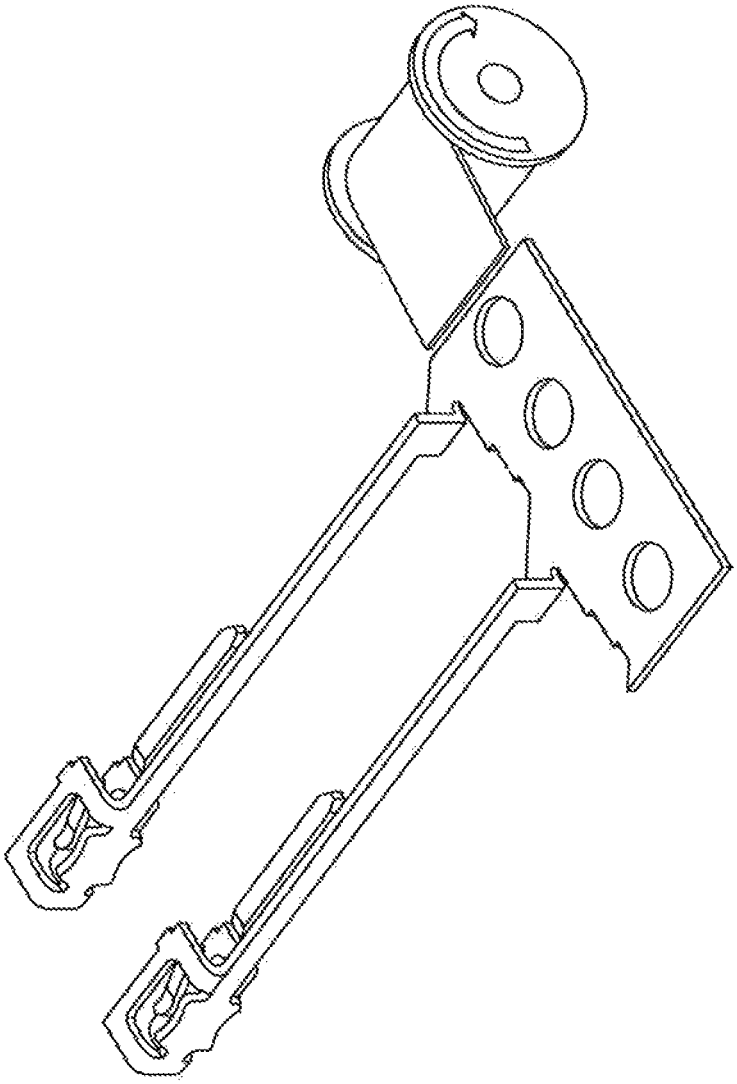
Figure 22B:
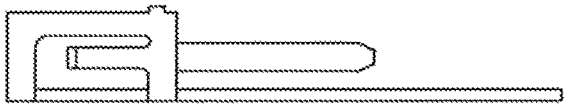
Figure 22A:
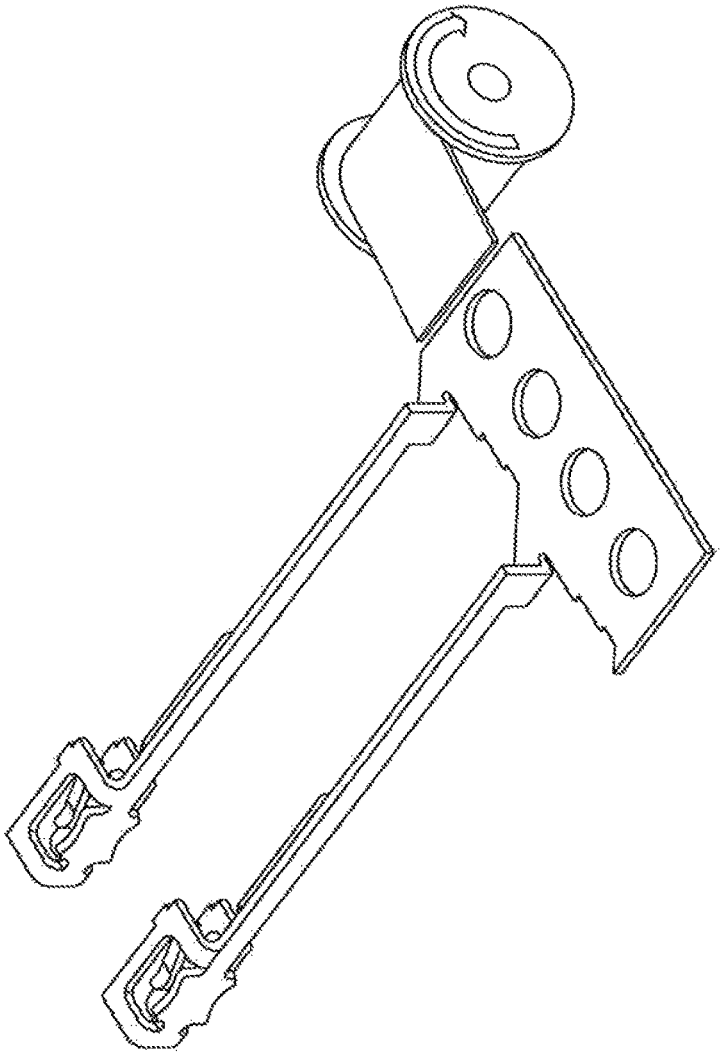
Figure 23B:
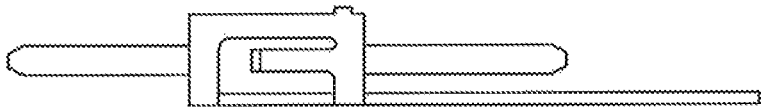
Figure 23A:
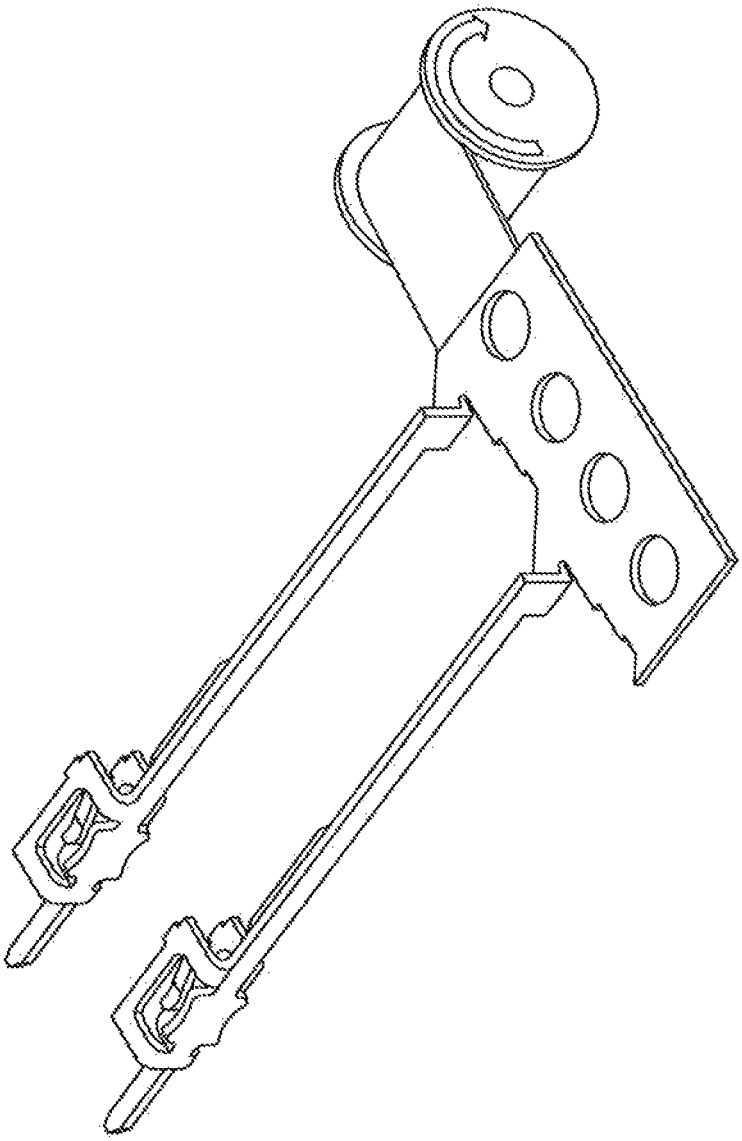
Figure 24B:
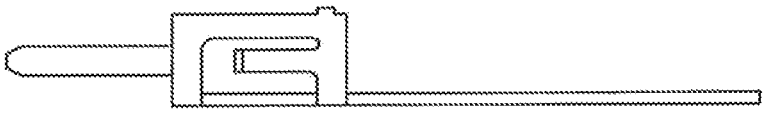
Figure 24A:
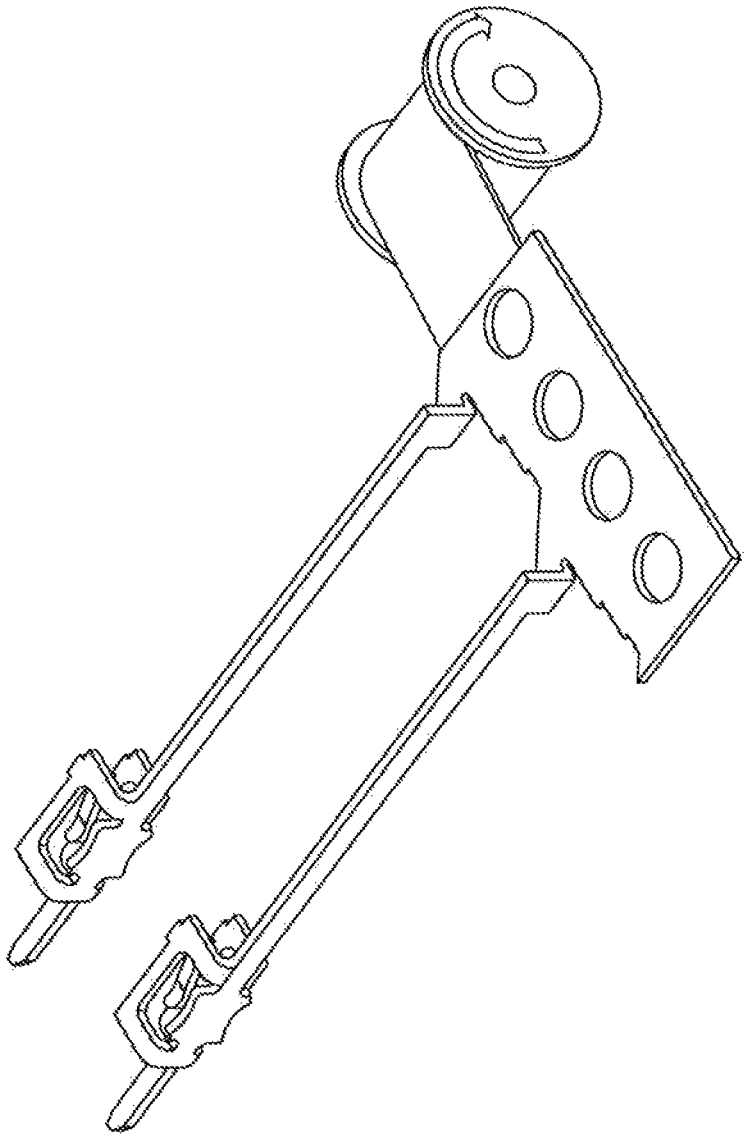
Figure 25B:
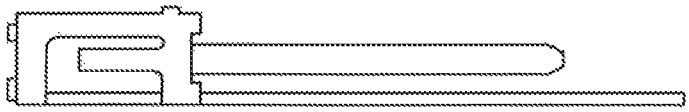
Figure 25A:
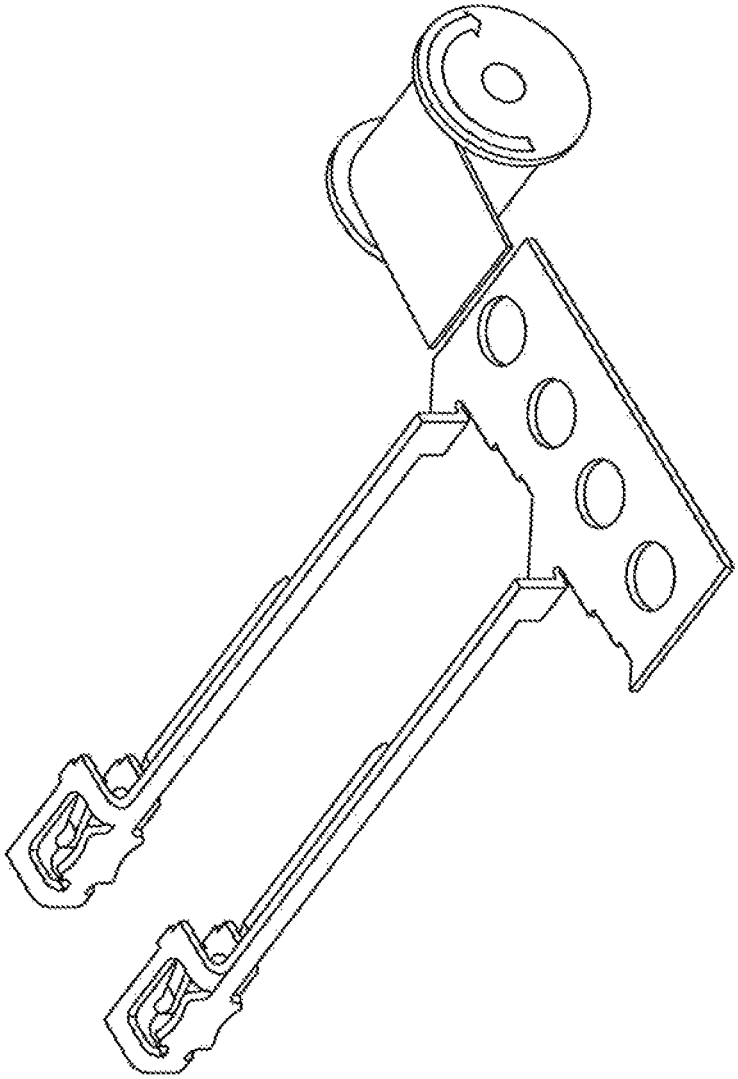
Figure 26B:
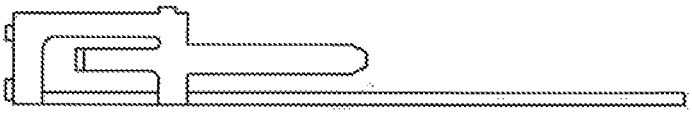
Figure 26A:
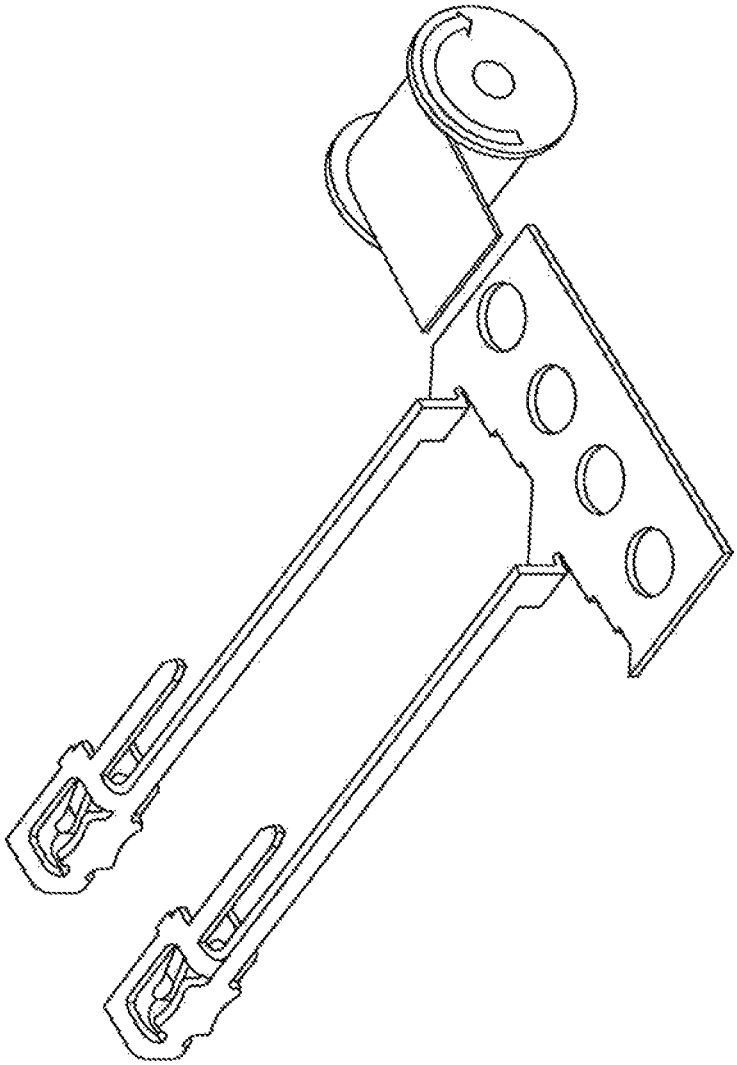
Figure 27B:
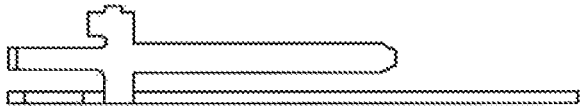
Figure 27A:
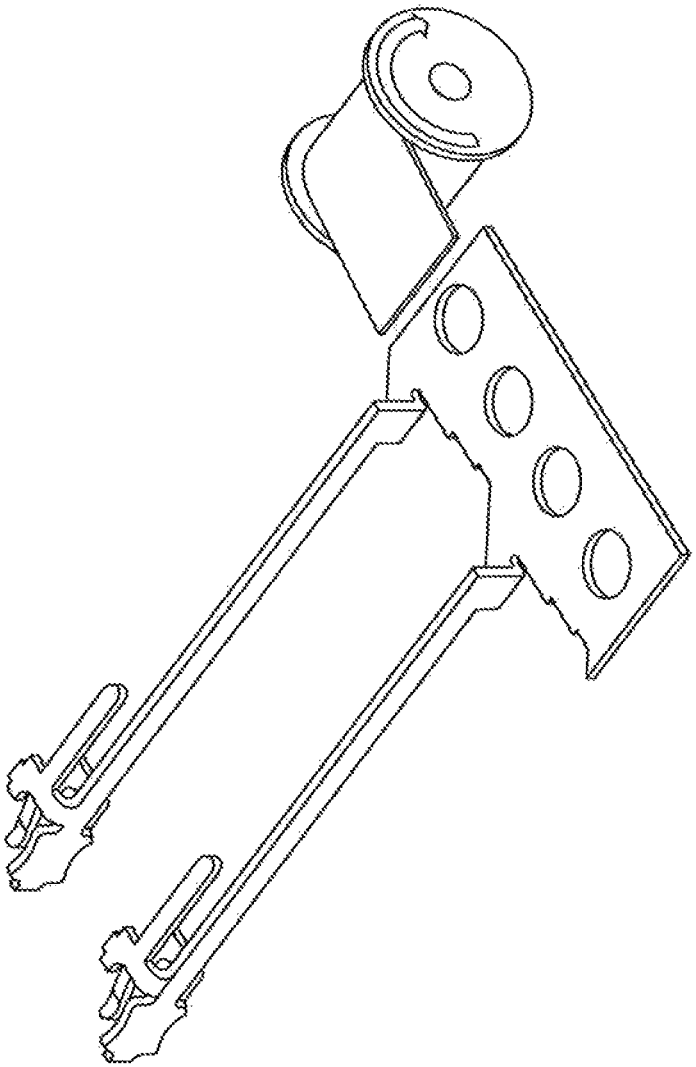
Figure 28B:
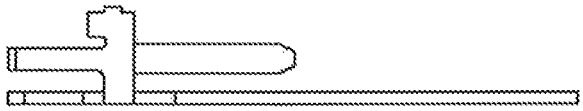
Figure 28A:
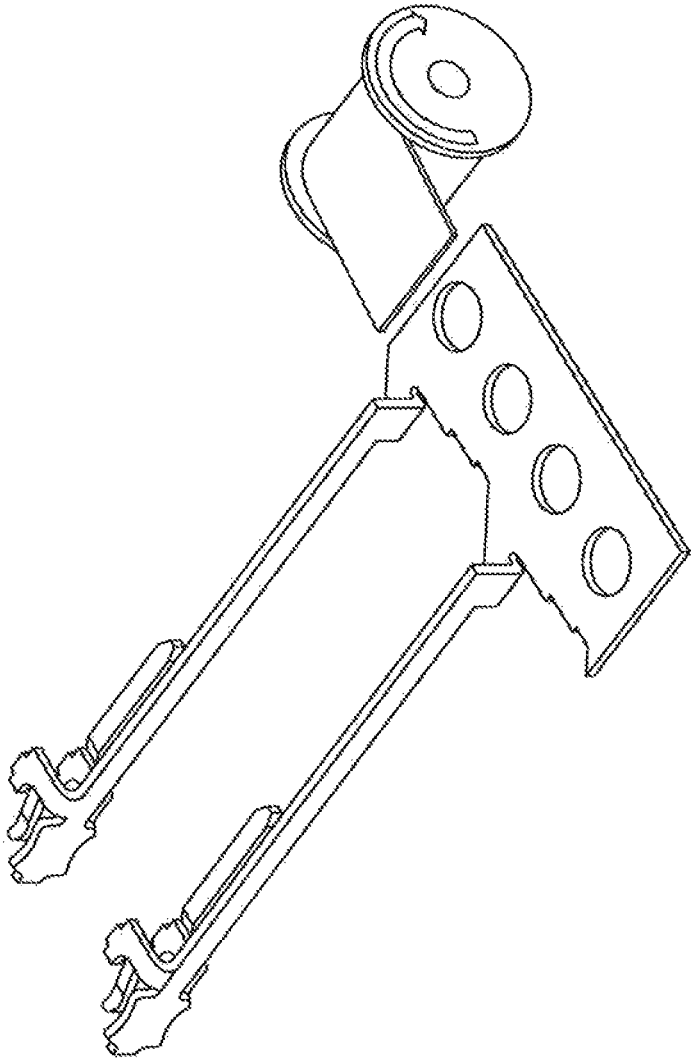
Figure 29B:
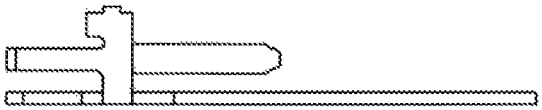
Figure 29A:
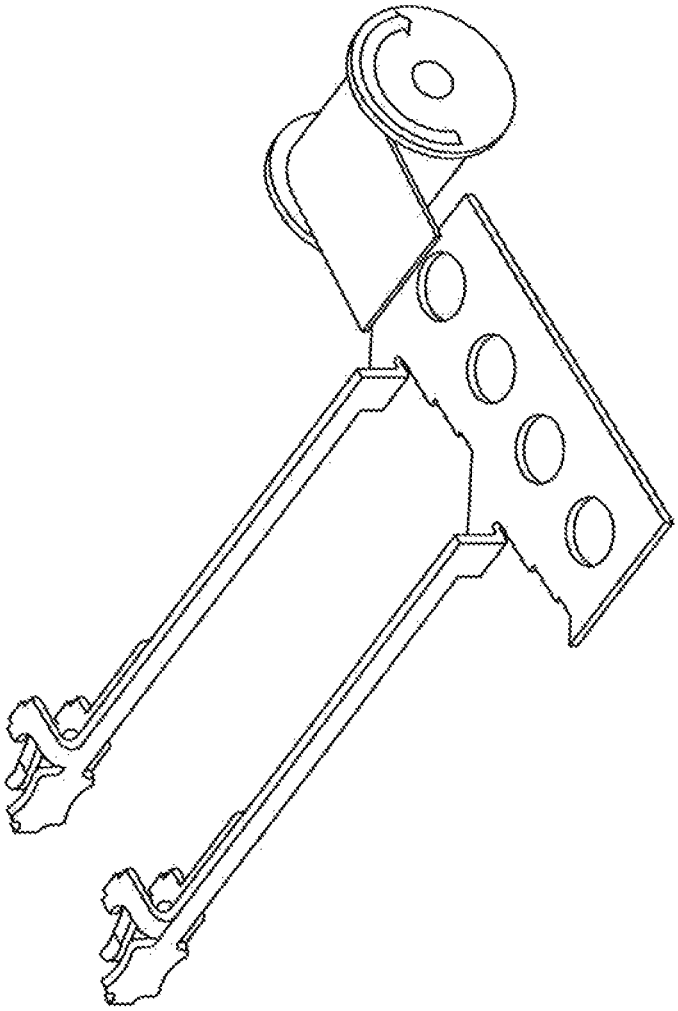

The retention feature may be wider than the contact arms as seen in FIGS. 5 and 10 for example. The retention feature may be orientated at a substantial right angle relative to both the contact arms as seen in FIGS. 4 and 14 for example. The electrical connector may further comprise a second solder tail as seen in FIGS. 7, 8, and 11 for example, where the first solder tail extends off of a main body of the contact at a first location and where the second solder tail extends from the contact at a second location. The second solder tail may extend off of the main body. The second solder tail may extends off of one of the contact arms. The second solder tail may extend off of the retention feature. The electrical connector may further comprise a third solder tail extending off of one of the main body, another one of the contact arms or the retention feature. The retention feature may have a substantially diamond shaped outline as seen in FIG. 14 for example. The retention feature may have a substantially hour-glass shaped outline as seen in FIG. 17 for example.

As illustrated by FIGS. 18A-29B an example method may comprise stamping a flat metal member to form an electrical contact attached to a carry strip, where the electrical contact is stamped to form opposing cantilevered contact arms configured to receive a male contact of a mating electrical connector therebetween, a retention feature assisting in locating the contact in a contact receiving area of the housing, and a first surface mount solder tail; and rolling the carry strip with the electrically contact attached onto a roll.

The stamping may further comprise the contact arms, retention feature and first solder tail extending in a same direction from a main body of the contact. The stamping may further comprise the retention feature having a general cantilevered shape extending from the main body of the contact. The stamping may further comprise forming a bridging portion connected to the retention feature and opposite ends of the main body of the contact. The stamping may further comprise forming the retention feature is the widest portion of the contact, where the retention feature extends past opposite sides of the contact proximate the contact arms.

It should be understood that the foregoing description is only illustrative. Various alternatives and modifications can be devised by those skilled in the art. For example, features recited in the various dependent claims could be combined with each other in any suitable combination(s). In addition, features from different embodiments described above could be selectively combined into a new embodiment. Accordingly, the description is intended to embrace all such alternatives, modifications and variances which fall within the scope of the appended claims.

What is claimed is:

1. An electrical connector comprising:

a housing; and a plurality of electrical contacts connected to the housing, where each of the contacts comprises:

a first portion comprising a plurality of cantilevered contact arms configured to receive a male contact of a mating electrical connector therebetween, and a retention feature assisting in locating the contact in a contact receiving area of the housing, and a first surface mount solder tail, wherein the first surface mount solder tail is attached to the first portion at a 180 degree bend.

2. The electrical connector of claim 1 where the contact further comprises a bridging portion connected to the retention feature and opposite ends of the main body of the contact.

3. The electrical connector of claim 1 where the retention feature is the widest portion of the contact and extends past opposite sides of the contact proximate the at least one cantilevered contact arm.

4. The electrical connector of claim 1 where the retention feature is flat.

5. The electrical connector of claim 1 where the retention feature is wider than the cantilevered contact arms.

6. The electrical connector of claim 1 where the retention feature is orientated at a substantial right angle relative to the plurality of cantilevered contact arms.

7. The electrical connector of claim 1 where the retention feature has a substantially diamond shaped outline.

8. The electrical connector of claim 1 where the retention feature has a substantially hour-glass shaped outline.

9. The electrical connector of claim 1 where the retention feature has opposite lateral sides which engage the housing to retain the electrical contact in the housing, where the retention feature is the widest portion of the electrical contact.

10. The electrical connector of claim 1, wherein the plurality of the contact arms are parallel to the first surface mount solder tail such that upon receiving the male contact, the contact arms exert a force on the male contact which is parallel to the first surface mount solder tail.

11. The electrical connector of claim 1 wherein:

the first portion further comprises a main body of the contact; and the plurality of cantilevered contact arms, retention feature and first surface mount solder tail extend in a same direction from the main body of the contact.

12. The electrical connector of claim 11 where the retention feature has a general cantilevered shape extending from the main body of the contact.

13. The electrical connector of claim 1 further comprising a second surface mount solder tail, where the first surface mount solder tail extends off of a main body of the contact at a first location and where the second surface mount solder tail extends from the contact at a second location.

14. The electrical connector of claim 13 where the second surface mount solder tail extends off of the main body.

15. The electrical connector of claim 13 where the second surface mount solder tail extends off of one of the plurality of cantilevered contact arms.

16. The electrical connector of claim 13 where the second surface mount solder tail extends off of the retention feature.

17. An electrical connector comprising:

a housing comprising a mating surface and a mounting surface, and plurality of openings in the mating surface forming contact receiving areas, wherein the plurality of contact receiving areas are disposed in a plurality of parallel rows; and a plurality of electrical contacts disposed within respective openings of the plurality of openings, wherein each of the plurality of electrical contacts comprises:

a first portion comprising at least one cantilevered contact arm configured to contact a male contact of a mating electrical connector inserted in the respective contact receiving area, and a retention feature pressing against the housing at opposing sides of the respective opening so as to locate the contact in the respective contact receiving area of the housing, and a first solder tail comprising a first end attached to the first portion and a second end extending through the mounting surface of the housing, wherein the at least one contact arm is aligned with the second end of the first solder tail;

wherein the first end of the first solder tail is attached to the first portion at a 180 degree bend.

18. The electrical connector of claim 17, wherein the at least one contact arm is two contact arms.

19. The electrical connector of claim 18 wherein the two contact arms are separated in a direction perpendicular to the plurality of parallel rows by a distance less than a width of the retention feature.

20. An electrical connector comprising:

a housing comprising a mounting face and a mating face offset from the mounting face in a first direction; and a plurality of electrical contacts connected to the housing, wherein each of the contacts comprises:

a first portion comprising a body adjacent the mating face, a retention feature assisting in locating the contact in a contact receiving area of the housing and at least one cantilevered contact arm configured to contact a male contact of a mating electrical connector inserted in the contact receiving area, wherein the at least one cantilevered contact arm has a fixed end coupled to the body and a free end, separated from the fixed end in the first direction, and a tail, wherein the tail has a first end attached to the body adjacent the mating face and a second end extending from the housing at the mounting face;

wherein the first end of the tail is attached to the body of the first portion at a 180 degree bend.

21. The electrical connector of claim 20, wherein the tail is a surface mount solder tail.

22. The electrical connector of claim 21, wherein the second end of the surface mount solder tail is bent at a 90 degree angle.

23. The electrical connector of claim 21, wherein the contact receiving areas extend from the mating face to the mounting face.

* * * * *